US005380056A

United States Patent [19]

Wu

[11] Patent Number: 5,380,056

[45] Date of Patent: Jan. 10, 1995

[54] VERTICAL HYDRAULIC HOIST DEVICE

[76] Inventor: Tain-Lai Wu, 7th Fl., No. 6, Shang Chih St., Ling Ya Dist., Kaohsiung, Taiwan, Prov. of China

[21] Appl. No.: 110,103

[22] Filed: Aug. 20, 1993

[51] Int. Cl.[6] ..... B66C 1/34; B66F 3/25

[52] U.S. Cl. ..... 294/82.15; 254/93 R

[58] Field of Search ..... 294/82.15, 82.16, 88; 91/19, 440; 188/67, 299, 318; 212/250; 254/93 R, 93 H; 414/626

[56] References Cited

U.S. PATENT DOCUMENTS

| | | | |
|---|---|---|---|
| 101,681 | 4/1870 | Towle | 294/82.15 X |
| 804,510 | 11/1905 | Vaughan | 294/82.15 X |
| 2,500,459 | 3/1950 | Hoover et al. | 294/82.15 X |
| 2,860,908 | 11/1958 | Peterson | 294/82.15 |
| 2,907,600 | 10/1959 | Lowery | 294/82.15 |
| 3,345,039 | 10/1967 | Gray | 254/93 R |
| 4,076,215 | 2/1978 | Landert et al. | 254/93 R |

*Primary Examiner*—Johnny D. Cherry

*Attorney, Agent, or Firm*—Hedman, Gibson & Costigan

[57] ABSTRACT

A vertical hydraulic hoist device includes a base, a tubular member with a lower end securely mounted on the base, a hoisting rod, an actuating assembly, a lifting assembly, and a stop assembly. The hoisting rod includes a plurality of vertically spaced annular recesses each of which defines an upper edge and an annular recess which tapers upwardly. The actuating assembly is mounted in an upper section of the tubular member, including upper and lower caps and a hollow actuating tube extending through the upper and lower caps, together defining an annular chamber therebetween in which working fluid is received. A piston is mounted in the chamber, while upper and lower openings are respectively formed in upper and lower sections of the tubular member and communicate with oil pipes through which the piston is controlled. The hollow actuating tube is securely connected to the piston to move therewith. The lifting assembly is mounted to the upper end of the hollow actuating tube to move therewith and engages with the upper edge of a recess above the actuating tube to effect the upward movement of the hoisting rod when the piston moves upward. When the piston stops as the article reaches the height to be lifted, the stop assembly prevents downward movement of the hoisting rod.

6 Claims, 5 Drawing Sheets

VERTICAL HYDRAULIC HOIST DEVICE

BACKGROUND OF THE INVENTION

1. Field of the Invention

The present invention relates to a novel hoist device and, more particularly, to a vertical hydraulic hoist device which lifts heavy articles, especially machines and devices.

2. Description of Related Art

Cranes are useful in hoisting and installing heavies, such as machines, devices, etc. However, in addition to the machines to be installed, a crane also occupies a considerable space for operation, which may cause, in addition to the expense of the crane, an intolerable cost for acquiring the required land. Furthermore, some cranes are designed for particular needs and then are often never used again.

Therefore, there has been a long and unfulfilled need for an improved hoist device which is inexpensive and occupies less space.

SUMMARY OF THE INVENTION

A vertical hydraulic hoist device provided by the present invention includes a base, a tubular member with a lower end securely mounted on the base, a hoisting rod, an actuating means, a lifting means, and a stop means.

The hoisting rod includes a plurality of vertically equidistantly spaced annular recesses each of which defines an upper edge and an annular surface which tapers upward. The hoisting rod can be of any desired length, depending upon the need. In operation, a hook member may be attached to a lower end of the hoisting rod for hooking the article to be hoisted.

The actuating means is mounted in an upper section of the tubular member, including upper and lower caps and a hollow actuating tube passing through the upper and lower caps, together defining an annular chamber therebetween in which working fluid is received. A piston is mounted in the chamber, while upper and lower openings are respectively formed in upper and lower sections of the tubular member and communicate with oil pipes. A control means is provided to control the upward and downward movements of the piston. The hollow actuating tube is securely connected to the piston to move therewith.

The lifting means includes a seat secured to the upper end of the hollow actuating tube to move therewith, an opening in a bottom thereof through which the hoisting rod passes, and a concave surface therein which tapers downward toward the opening. A lifting member is removably mounted in the concave surface around the hoisting rod. Preferably, the lifting member consists of three radially and spacedly mounted lifting segments, each comprising an outer periphery having a configuration which conforms to the lower section of the downwardly tapering concave surface of the seat and an inner periphery having a configuration which mates with the upper edge of the annular recess in the hoisting rod to effect the upward movement of the hoisting rod.

Similar to the lifting means, the stop means includes a second seat securely mounted on the base, a second opening in a bottom thereof through which the hoisting rod passes, and a second concave surface therein which tapers downward toward the second opening. A stop member is mounted in the concave surface around the hoisting rod. Preferably, the stop member consists of three radially and spacedly mounted stop segments, each comprising an outer periphery having a configuration which conforms to the lower section of the downwardly tapering concave surface of the second seat and an inner periphery having a configuration which engages with the upper edge of the annular recess in the hoisting rod to prevent downward movement of the hoisting rod.

In operation, the base is secured to a position directly above the article to be hoisted. The hoisting rod extends upward through the base, the stop means, the hollow actuating tube, and the lifting means. The article to be hoisted is hooked by the hook member. When the piston moves upward, the hollow actuating tube, the lifting means, and the hoisting rod together move upward. During the upward stroke of the piston, the lifting segments engage with the upper edge of a recess above the hollow actuating tube, thereby effecting the upward movement of the hoisting rod, while the stop segments which are initially fittingly placed in the lower section of the concave surface of the stop means are moved upward to an upper section of concave surface of the stop means, thereby not affecting the upward movement of the hoisting rod.

When the piston stops as the article has reached the height to be lifted, the stop segments fall back to the lower section of the downwardly tapering concave surface, thereby preventing downward movement of the hoisting rod. For returning the piston, the lifting segments are removed first, and then the piston is urged to move downward until the piston reaches its lowest position where the lifting segments may be reinserted for hoisting.

Other objects, advantages, and novel features of the invention will become more apparent from the following detailed description when taken in conjunction with the accompanying drawings.

DESCRIPTION OF THE PREFERRED EMBODIMENT

Figure 1:
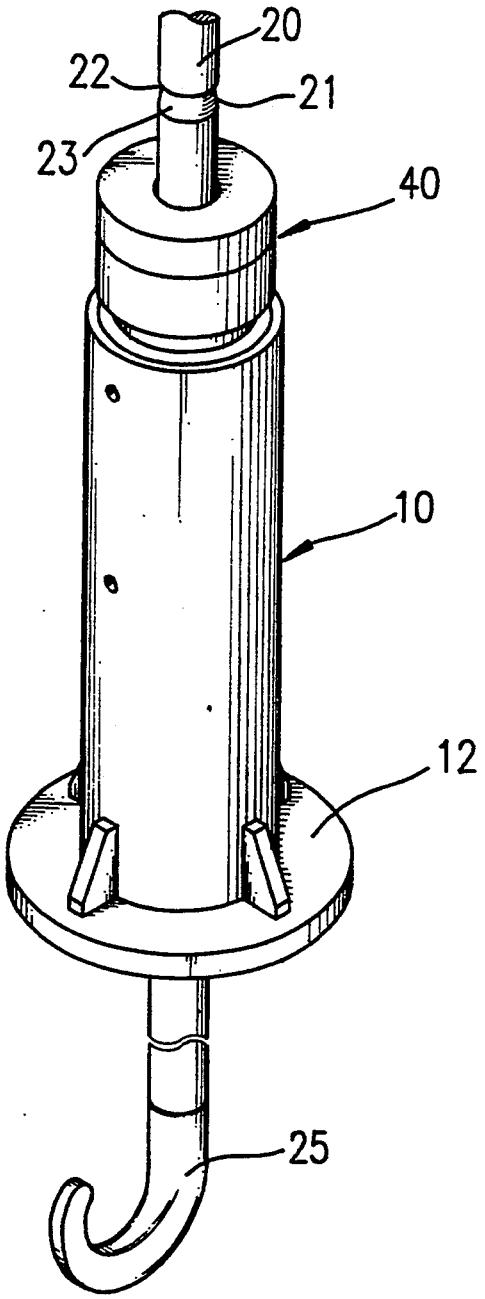
FIG. 1 is a perspective view of a vertical hydraulic hoist device in accordance with the present invention.
Figure 2:
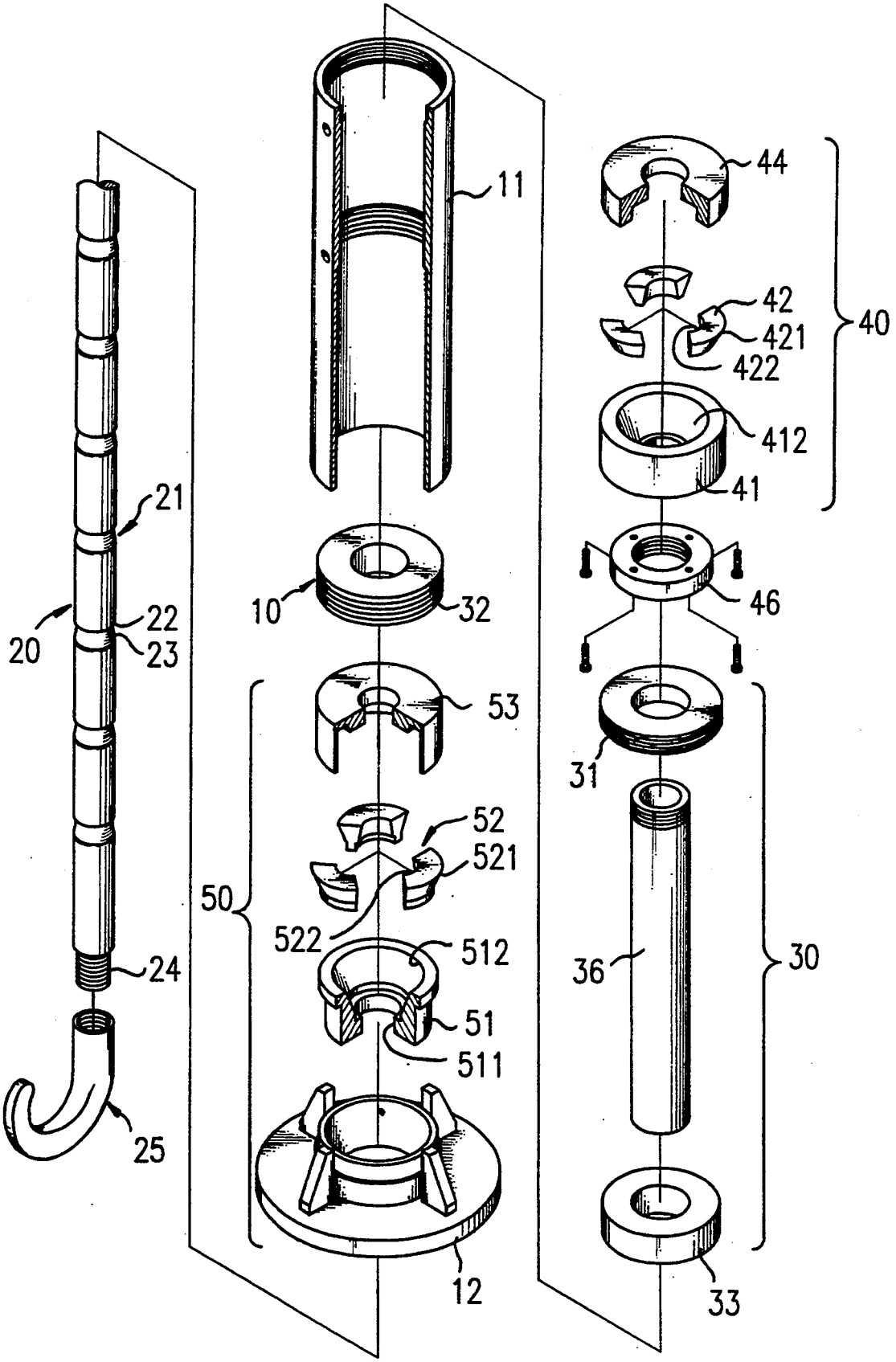
FIG. 2 is an exploded view of the vertical hydraulic hoist device.
Figure 3:
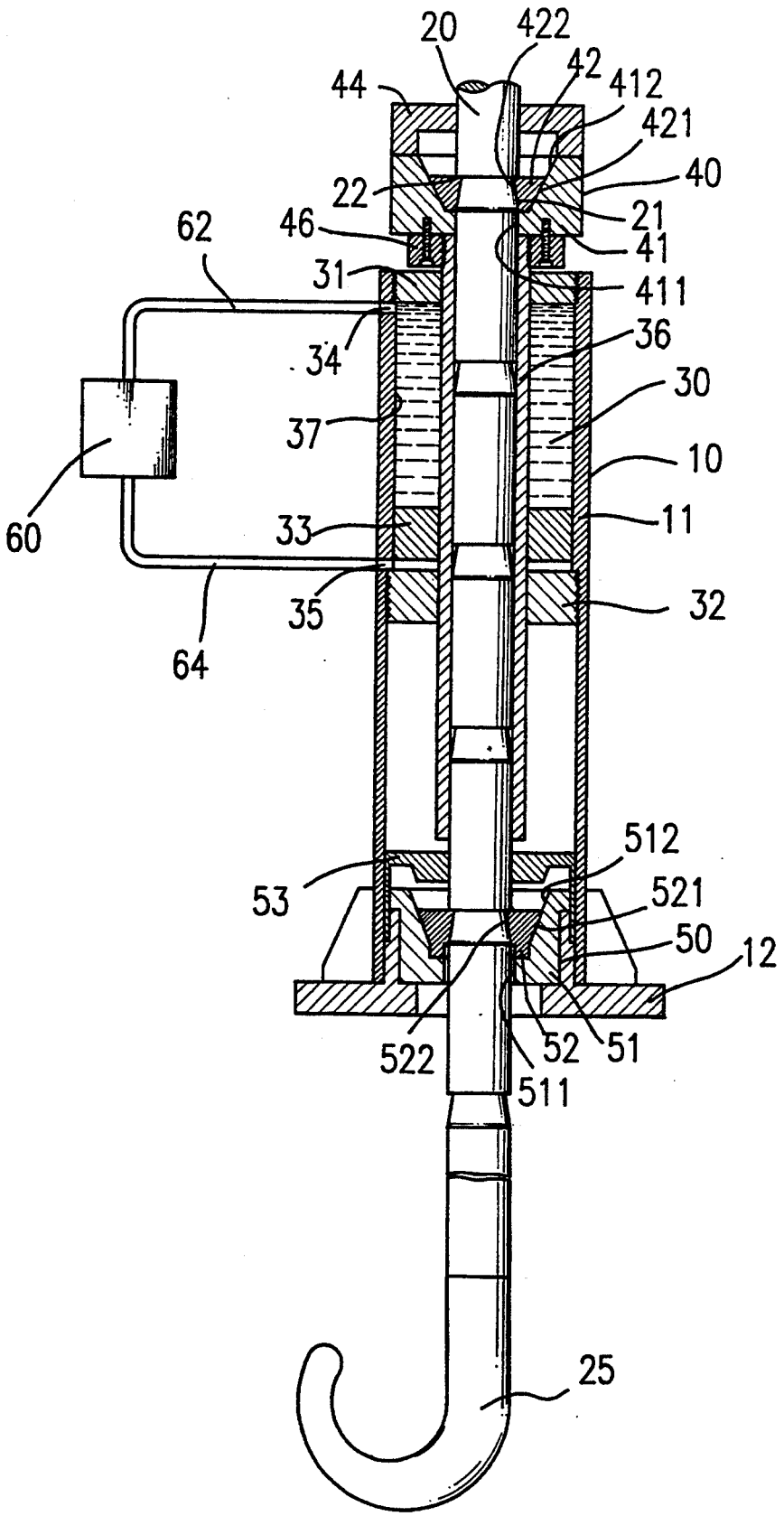
FIG. 3 is a side view, partially in cross-section, of the vertical hydraulic hoist device.

Referring to the drawings and initially to FIGS. 1 through 3, a vertical hydraulic hoist device 10 in accordance with the present invention generally includes a base 12, a tubular member 11 with a lower end securely mounted on the base 12, a hoisting rod 20, an actuating means 30, a lifting means 40, and a stop means 50.

The hoisting rod 20 includes a plurality of vertically and equidistantly spaced annular recesses 21 each of which defines an upper edge 22 and an annular surface 23 which tapers upward. The hoisting rod 20 can be of any desired length, depending upon the need. In operation, a hook member 25 may be attached to a lower threaded end 24 of the hoisting rod 20 for hooking the article to be hoisted.

The actuating means 30 is mounted in an upper section of the tubular member 11, including upper and lower caps 31 and 32 and a hollow actuating tube 36 which together define an annular chamber 37 therebetween in which working fluid is received. The lower end of the hollow actuating tube 36 extends through the lower cap 32 to a position above the base 12 while the upper end of the hollow actuating tube 36 extends through the upper cap 31, which will be explained later. A piston 33 is mounted in the chamber 37, while upper and lower openings 34 and 35 are respectively formed in upper and lower sections of the tubular member 11 and communicate with oil pipes 62 and 64. A control system 60 is provided to control upward and downward movements of the piston 33. It is appreciated that other suitable devices may be used to control the piston 33 without departing from the spirit and scope of the invention. The hollow actuating tube 36 is securely connected to the piston 33 to move therewith.

The lifting means 40 includes a seat 41 secured by member 46 to the upper end of the hollow actuating tube 36 to move therewith, an opening 411 (see FIG. 3.) in a bottom thereof through which the hoisting rod 20 passes, and a concave surface 412 therein which tapers downward toward the opening 411. A lifting member 42 is removably mounted in the concave surface 412 around the hoisting rod 20. Preferably, the lifting member 42 consists of three radially and spacedly mounted lifting segments, each comprising an outer periphery 421 having a configuration which conforms to the lower section of the downwardly tapering concave surface 412 of the seat 41 and an inner periphery 422 having a configuration which mates with the upper edge 22 of the annular recess 21 in the hoisting rod 20 to effect the upward movement of the hoisting rod 20 which will be explained later. Optionally, an upper cap 44 may be removably mounted above the seat 41 to provide a sealing function.

Similar to the lifting means 40, the stop means 50 also includes a seat 51 securely mounted on the base 12, an opening 511 in a bottom thereof through which the hoisting rod 20 passes, and a concave surface 512 therein which tapers downward toward the opening 511. A stop member 52 is mounted in the concave surface 512 around the hoisting rod 20. Preferably, the stop member 52 consists of three radially and spacedly mounted stop segments, each comprising an outer periphery 521 having a configuration which conforms to the lower section of the downwardly tapering concave surface 512 of seat 51 and an inner periphery 522 having a configuration which may engage with the upper edge 22 of the annular recess 21 in the hoisting rod 20 to prevent downward movement of the hoisting rod 20, which will be explained below. Optionally, an upper cap 53 may be removably mounted above seat 51 to provide a sealing function.

Figure 4:
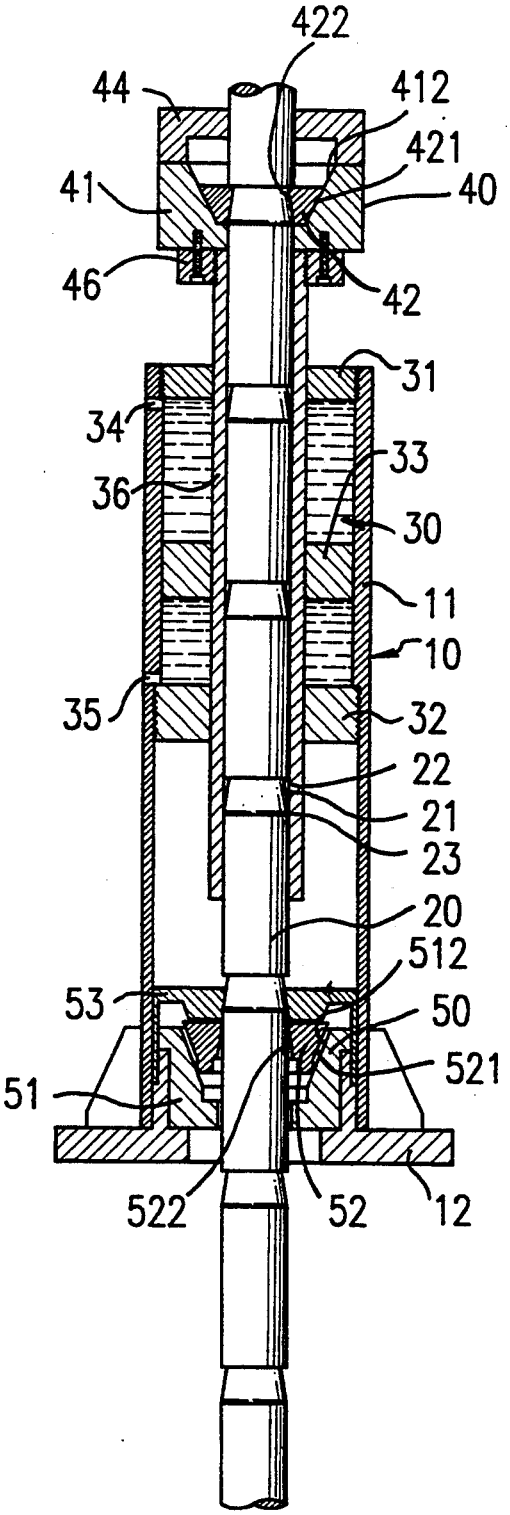
FIGS. 4 through 7 are side views, partially in cross-section, illustrating operation of the vertical hydraulic hoist device.

In operation, the base 12 is secured to a position directly above the article to be hoisted at a height where the article is to be installed. As shown in FIG. 3, the hoisting rod 20 extends upward through the base 12, the stop means 50, the hollow actuating tube 36, and the lifting means 40. The article to be hoisted is hooked by the hook member 25. When the piston 33 moves upward under the control of the control system 60, the hollow actuating tube 36, the lifting means 40, and the hoisting rod 20 together move upward to carry the article upward. Referring now to FIG. 4, during the upward stroke of the piston 33, the lifting segments 42 engage with the upper edge 22 of a recess 21 above the hollow actuating tube 36, thereby effecting the upward movement of the hoisting rod 20, while the stop segments 52 which are initially fittingly placed in the lower section of the concave surface 512 are moved upward to an upper section of concave surface 512, thereby not affecting the upward movement of the hoisting rod 36.

Figure 5:
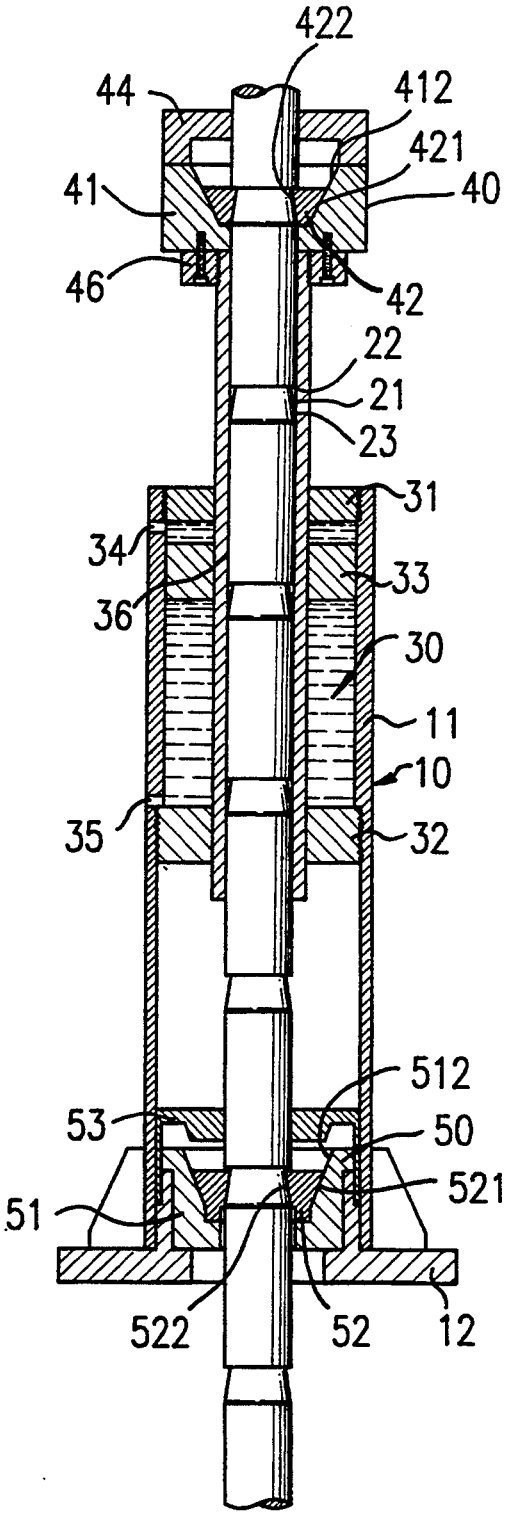

When the piston 33 stops as the article has reached the height to be lifted, the stop segments 52 fall back to the lower section of the downwardly tapering surface 512, as shown in FIG. 5, thereby preventing downward movement of the hoisting rod 20 as the inner peripheries 522 of the stop segments 52 are right below the upper edge 22 of the recess 21 of the hoisting rod 20.

Figure 6:
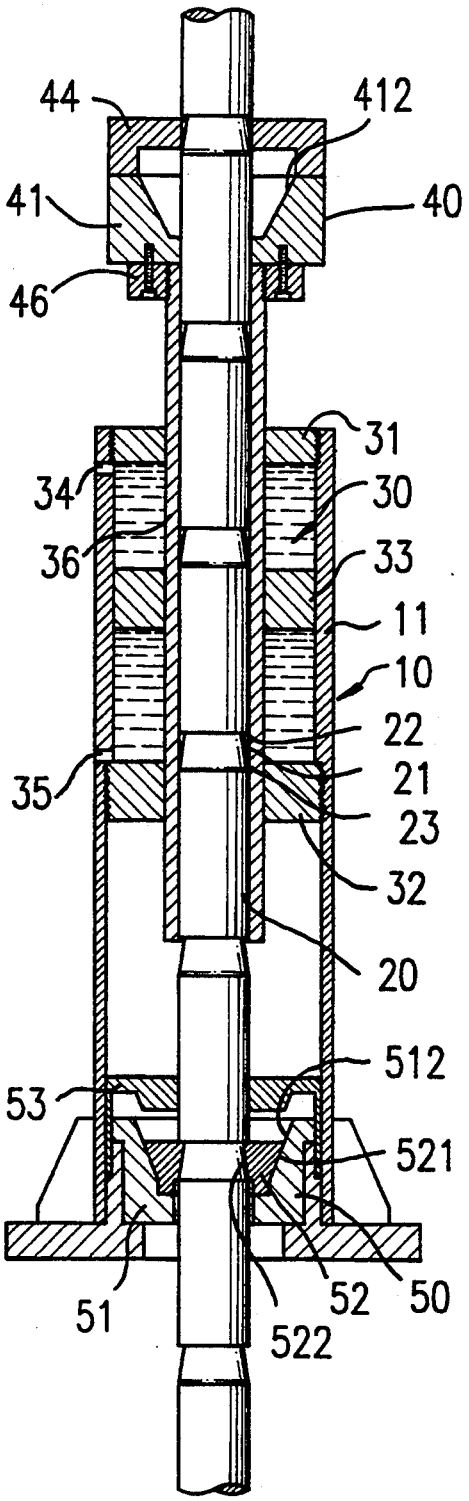
Figure 7:
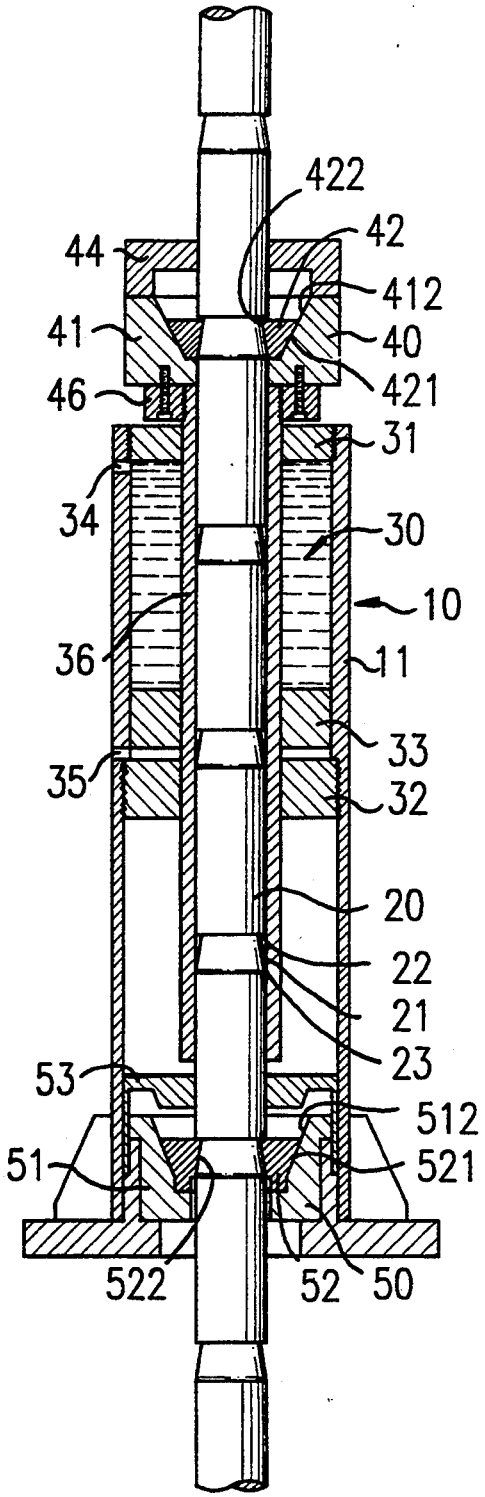

For returning the piston 33, the lifting segments 42 are removed first, and then the piston 33 is urged by the control system 60 to move downward, as shown in FIG. 6, until the piston 33 reaches its lowest position shown in FIG. 7 where the lifting segments 42 may be reinserted for hoisting. Alternatively, the lifting segments 42 and the stop segments 52 may be simultaneously removed to allow a downward movement of the hoisting rod 20.

The present device has the following advantages:

(1) it occupies less space as it operates only in the vertical direction;

(2) the articles hoisted by conventional cranes sway during operation, which also requires a greater force to hoist the articles, while the present device moves vertically to avoid such problems; and (3) the manufacturing cost is extremely low when compared to a conventional bulky crane; furthermore, several vertical hoist devices may work together to hoist a relatively heavy article.

Although the invention has been explained in relation to its preferred embodiment, it is to be understood that many other possible modifications and variations can be made without departing from the spirit and scope of the invention as hereinafter claimed.

I claim:

1. A vertical hoist device comprising:

a base;

a tubular member with a lower end securely mounted on the base;

a hoisting rod extending through said tubular member and said base, including a plurality of vertically spaced annular recesses each of which defines an upper edge and an annular surface which tapers downward;

an actuating means mounted in an upper section of said tubular member, including upper and lower caps and a hollow actuating tube extending through said upper and lower caps, defining an annular chamber therebetween in which working fluid is received, a piston being mounted in said chamber, upper and lower openings being respectively formed in upper and lower sections of the tubular member, and means for effecting upward and downward movements of said piston, said hollow actuating tube being securely connected to said piston to move therewith;

a lifting means secured to said hollow actuating tube to move therewith, said lifting means engaging with said upper edge of one of said recesses to effect upward movement of said piston; and a stop means allowing upward movement of said hoisting rod and preventing downward movement of said hoisting rod.

2. The vertical hoist device as claimed in claim 1 wherein a hook member is attached to a lower end of said hoisting rod for hooking an article to be hoisted.

3. The vertical hoist device as claimed in claim 1 wherein said lifting means includes a seat secured to an upper end of the hollow actuating tube to move therewith, an opening in a bottom thereof through which said hoisting rod passes, and a concave surface therein which tapers downward toward said opening, a lifting member being removably mounted in said concave surface around said hoisting rod for engaging with said upper edge of said recess.

4. The vertical hoist device as claimed in claim 3 wherein said lifting member includes a plurality of radially and spacedly mounted lifting segments, each comprising an outer periphery having a configuration which conforms to a lower section of said downwardly tapering concave surface of said seat and an inner periphery having a configuration which mates with said upper edge of said annular recess in said hoisting rod to effect said upward movement of said hoisting rod.

5. The vertical hoist device as claimed in claim 1 wherein said stop means includes a seat securely mounted on said base, an opening in a bottom thereof through which said hoisting rod passes, and a concave surface therein which tapers downward toward said opening, a stop member being mounted in said concave surface around said hoisting rod.

6. The vertical hoist device as claimed in claim 5 wherein said stop member includes a plurality of radially and spacedly mounted stop segments, each comprising an outer periphery having a configuration which conforms to a lower section of said downwardly tapering concave surface of said seat and an inner periphery having a configuration which mates with said upper edge of said annular recess in said hoisting rod to prevent downward movement of said hoisting rod.

* * * * *